US006698145B2

(12) United States Patent
Berger, Jr.

(10) Patent No.: US 6,698,145 B2
(45) Date of Patent: Mar. 2, 2004

(54) SURFACE MOUNT WINDOW FOR DOORS

(76) Inventor: Allen Berger, Jr., 12195 NW. 98 Ave., Hialeah Gardens, FL (US) 33018

( * ) Notice: Subject to any disclaimer, the term of this patent is extended or adjusted under 35 U.S.C. 154(b) by 0 days.

(21) Appl. No.: 10/244,842

(22) Filed: Sep. 17, 2002

(65) Prior Publication Data

US 2004/0016189 A1 Jan. 29, 2004

Related U.S. Application Data

(63) Continuation-in-part of application No. 10/201,762, filed on Jul. 23, 2002.

(51) Int. Cl.[7] ..... E06B 3/00
(52) U.S. Cl. ..... 52/208; 52/455
(58) Field of Search ..... 52/208, 455

(56) References Cited

U.S. PATENT DOCUMENTS 2,278,369 A * 3/1942 Hall
2,356,878 A * 8/1944 Painter
4,073,986 A * 2/1978 Keslar et al.
4,546,986 A * 10/1985 Roselli
4,947,597 A * 8/1990 Simpson ..... 52/208
5,035,096 A * 7/1991 Ohtake et al. ..... 20/208
5,373,672 A * 12/1994 Schulz ..... 52/208 X
5,577,355 A * 11/1996 Leonelli
6,280,826 B1 * 8/2001 Woll et al.
6,555,202 B2 * 4/2003 Shukuri et al.
6,569,787 B1 * 5/2003 Snelling

* cited by examiner

*Primary Examiner*—Robert Canfield
(74) *Attorney, Agent, or Firm*—J. Sanchelima; A. Bordas

(57) ABSTRACT

A window assembly for garage doors having an opening with cooperative dimensions to receive a transparent panel with a reduced surface on one side and a peripheral flange making the outer surface larger than the internal surface. The underside of the peripheral flange member comes in abutting contact with the panel's external surface to which it is glued. An external frame member is mounted over the peripheral edge of the external side of the transparent panel. An internal frame member is mounted over the peripheral edge of internal surface. Fastening members are used to keep the transparent panel member in place.

2 Claims, 2 Drawing Sheets

SURFACE MOUNT WINDOW FOR DOORS

OTHER RELATED APPLICATIONS

The present application is a continuation-in-part of the pending U.S. patent application Ser. No. 10/201,762, filed on Jul. 23, 2002 for Window Assembly for Opening Closures, which is hereby incorporated by reference.

II. BACKGROUND OF THE INVENTION

1. Field of the Invention

The present invention relates to a surface mount window for doors, and more particularly, for garage doors.

2. Description of the Related Art

Many designs for garage door windows have been designed in the past. None of them, however, includes a resistant and simple configuration as in the present application. The applicant has reduced the number of components of the embodiments for the invention subject of the parent application to a minimum. This distillation resulted in the most economical configuration for garage window doors that can still withstand considerable wind loads.

Window assemblies are typically mounted on panels. They are designed to enhance the aesthetic appeal of the closures (doors) while permitting daylight to go through. However, the window assemblies used in conventional garage doors include frames that cannot withstand high winds, such as those that develop in certain areas, such as South Florida. Local construction codes include wind tests that require reinforcement of these window assemblies and many times these added structures detract from the aesthetics of the window design. Garage doors, for instance, typically include a number of hingedly connected panels that are moved from a vertical position to a horizontal overhead position over tracks. The conventional window assemblies in these doors fail to meet these tests. Thus, the desirability of a sturdier structure but without including costly components.

The advantages of the present invention, as it will be more fully explained in the following paragraphs, include a simple window assembly that can be readily installed around the edges of the aperture defining the window. The assembly is thus capable of retaining the transparent panel while absorbing the impact energy of high winds and flying objects.

Other patents describing the closest subject matter provide for a number of more or less complicated features that fail to solve the problem in an efficient and economical way. None of these patents suggest the novel features of the present invention.

III. SUMMARY OF THE INVENTION

It is one of the main objects of the present invention to provide a window assembly that can be readily mounted through an opening in a garage door panel having cooperative dimensions.

It is another object of this invention to provide a window assembly that can withstand high wind loads.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

IV. BRIEF DESCRIPTION OF THE DRAWINGS

With the above and other related objects in view, the invention consists in the details of construction and combination of parts as will be more fully understood from the following description, when read in conjunction with the accompanying drawings in which.

V. DETAILED DESCRIPTION OF THE PREFERRED EMBODIMENT

Figure 1:
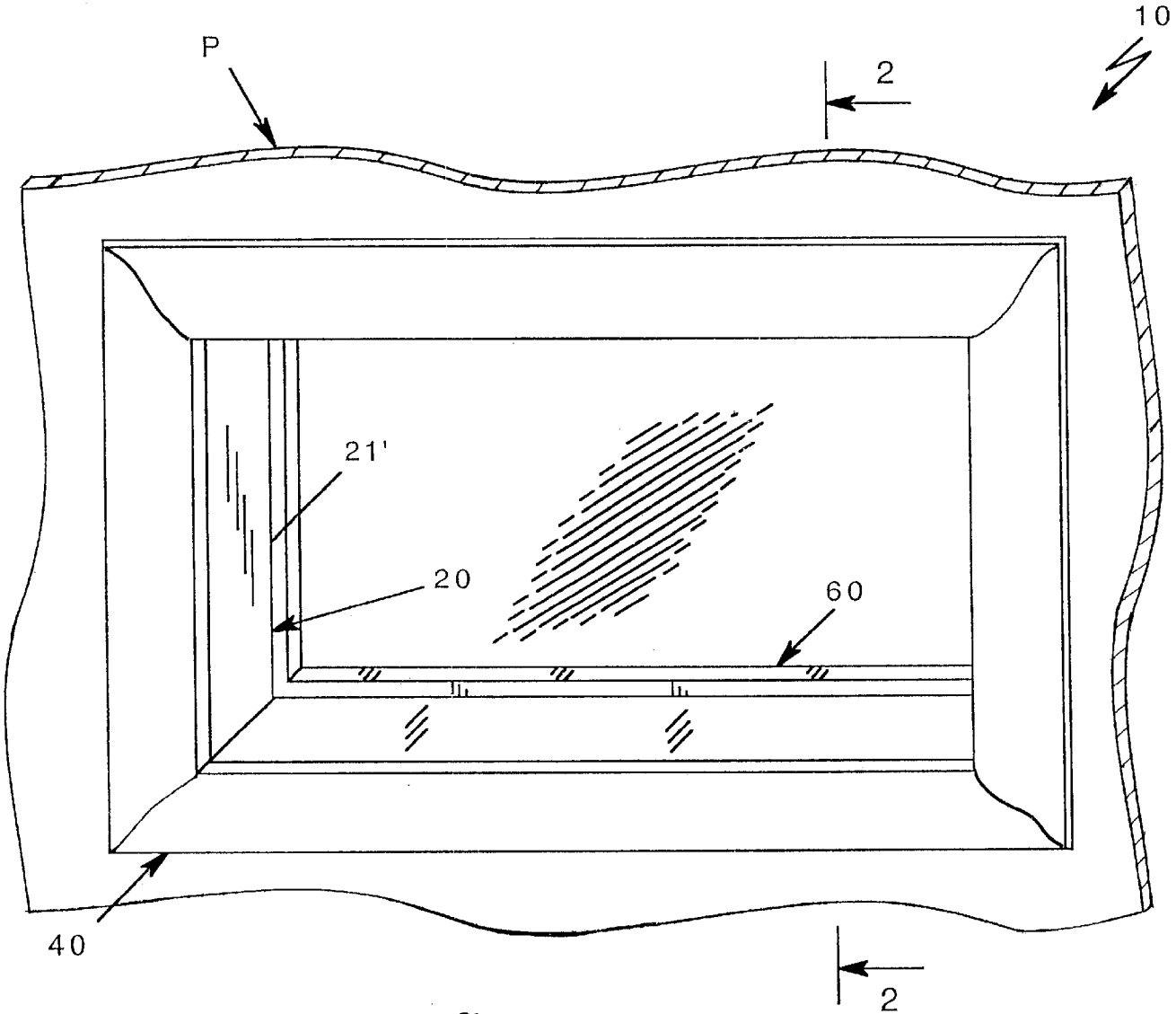
FIG. 1 represents an isometric view of one of the preferred embodiments for surface mount window for doors, object of the present invention.
Figure 2:
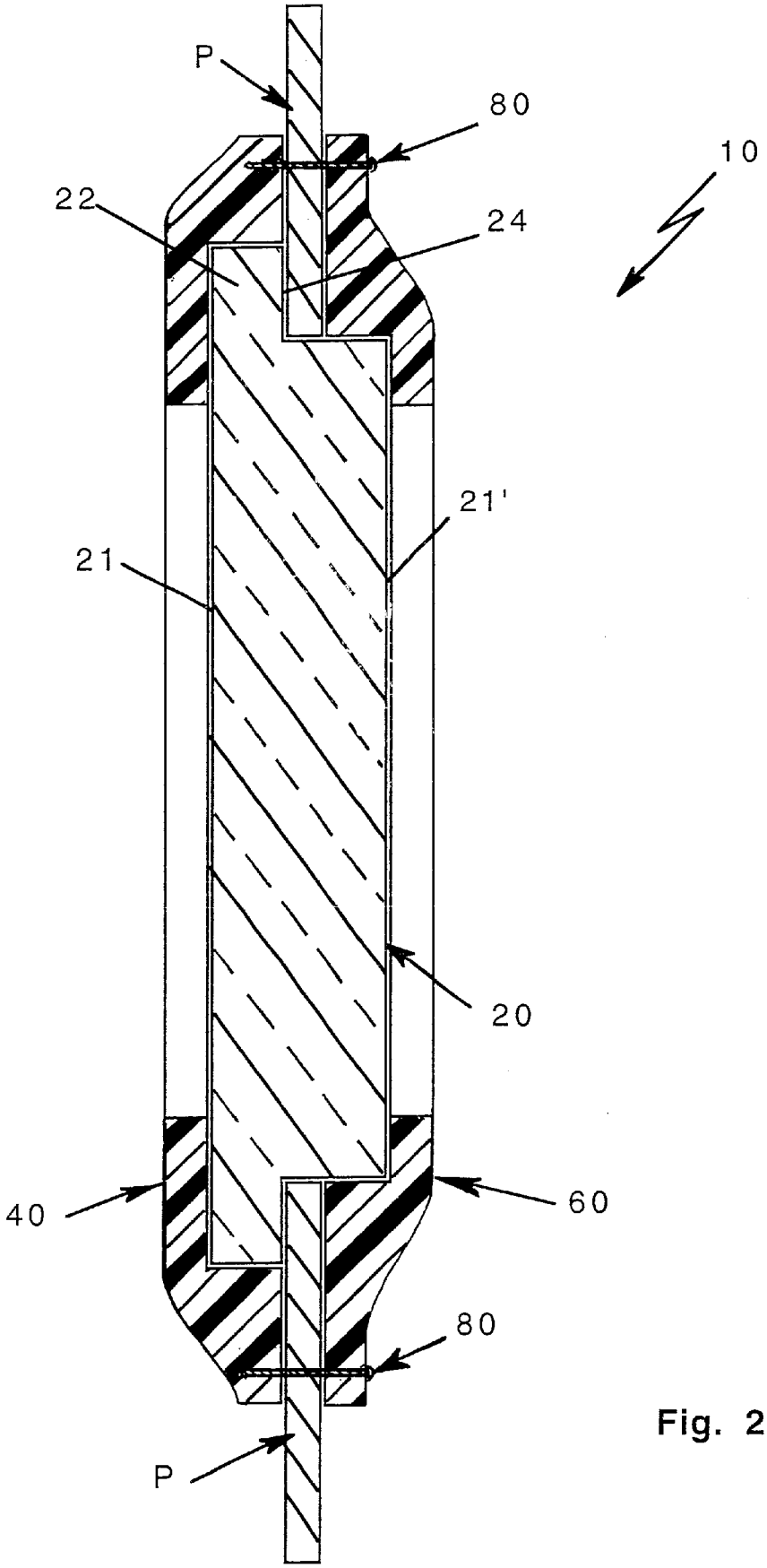
FIG. 2 illustrates a cross-sectional view taken along line 2—2 in FIG. 1.

Referring now to the drawings, where the present invention is generally referred to with numeral 10, it can be observed that it basically includes transparent panel 20, external frame assembly 40, internal frame assembly 60 and fastening members 80. Transparent panel 20 has external surface 21 and internal surface 21', the latter being smaller than the former. Transparent panel 20 has a peripheral flange 22 defining peripheral underside surface 24 that comes in abutting contact with the external surface of panel P. An opening in panel P has cooperative dimensions to receive through internal surface 21'.

Surface 24 is kept against the outer surface of panel P through different methods. One is by using an adhesive (like epoxies). Another method is by using fastening members 80.

External and internal frame assemblies 40 and 60 are mounted over the edges of external and internal surfaces 21 and 21', covering the latter. Frame assemblies 40 and 60 also provide a mass for receiving fastening members 80 further securing transparent panel 20 in place.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A window assembly for garage doors, comprising:

A) a transparent panel having an external surface and an internal surface, said external surface including a peripheral flange member making said external surface larger than said internal surface with respective peripheral edges, and said peripheral flange member further including a peripheral underside surface that comes in abutting contact against the peripheral external surface adjacent to an opening in a garage panel with cooperative dimensions to permit said internal surface to go through; and B) means for mounting said transparent panel on said garage panel, wherein said means for mounting said transparent panel on said garage panel includes an external frame assembly and an internal frame assembly, both mounted on said garage panel sandwiching said peripheral edges.

2. The window assembly set forth in claim 1 wherein said means for mounting said transparent panel on said garage panel includes fastening means for securing said internal and external frame members to said garage panel.

* * * * *